US006021922A

United States Patent [19]

Bilskie et al.

[11] Patent Number: 6,021,922

[45] Date of Patent: Feb. 8, 2000

[54] SELF-CONTAINED HIGH PRESSURE PNEUMATIC BEVERAGE DISPENSING SYSTEM

[76] Inventors: Richard P. Bilskie, 265 Monica Dr., Grantville, Ga. 30220; Edward N. Oyler, 212 Aaron Young Rd., Newnan, Ga. 30263; Harold F. Stover, 218 Four Seasons Dr., Grantville, Ga. 30220

[21] Appl. No.: 08/965,711

[22] Filed: Nov. 7, 1997

Related U.S. Application Data

[63] Continuation-in-part of application No. 60/030,628, Nov. 8, 1996.

[51] Int. Cl.[7] ..... B67D 5/08

[52] U.S. Cl. ..... 222/67; 222/129.2; 222/136

[58] Field of Search ..... 222/399, 146.6, 222/136, 386.5, 129.1, 129.2, 51, 67

[56] References Cited

U.S. PATENT DOCUMENTS

| | | | |
|---|---|---|---|
| 3,731,845 | 5/1973 | Booth | 222/67 |
| 4,313,897 | 2/1982 | Garrard | 261/64 |
| 4,560,089 | 12/1985 | McMillin et al. | 222/399 |
| 5,190,189 | 3/1993 | Zimmer et al. | 222/67 |
| 5,191,999 | 3/1993 | Cleland | 222/67 |
| 5,411,179 | 5/1995 | Oyler et al. | 222/129 |
| 5,553,749 | 9/1996 | Oyler et al. | 222/129.1 |

*Primary Examiner*—Philippe Dergkshani
*Attorney, Agent, or Firm*—Thomas, Kayden, Horstemeyer & Risley, L.L.P.

[57] ABSTRACT

A self-contained high pressure pneumatic beverage dispensing system configured for portable or fixed installations. The beverage system is designed to dispense carbonated and noncarbonated mixed beverages, as well as any carbonated and noncarbonated unmixed beverages in liquid form. In particular, the self-contained pneumatic beverage dispensing system includes a high pressure carbonator tank, a refillable source of $CO_2$ gas at high pressure, a source of pressurized water, a carbonator tank water level switch and water valve, and a beverage dispenser valve. In a first embodiment, the source of pressurized water comprises a high pressure water tank containing water that is pressurized with $CO_2$ gas. In a second embodiment, the source of pressurized water comprises a low pressure water tank, and a high pressure water pump that is used to raise the pressure of the water supplied by the low pressure water tank. In a third embodiment, the source of pressurized water comprises a large pneumatically-controlled single cycle high pressure pump. In all of the embodiments, the carbonator tank water level switch sends either a pneumatic or electrical signal to the carbonator tank water valve when the carbonator tank is low so that the carbonator tank can be refilled with high pressure water from the high pressure water source.

15 Claims, 6 Drawing Sheets

SELF-CONTAINED HIGH PRESSURE PNEUMATIC BEVERAGE DISPENSING SYSTEM

CROSS-REFERENCE TO RELATED APPLICATION

The present application claims the benefit of the filing date of U.S. Provisional application Ser. No. 60/030,628, filed Nov. 8, 1996.

FIELD OF THE INVENTION

The present invention relates generally to a beverage dispensing system configured for portable or fixed installations. More particularly, the present invention relates to a self-contained, high pressure pneumatic beverage dispensing system including a carbonator tank level water switch coupled to a carbonator tank water valve. The pneumatic beverage dispensing system is especially adapted for use on commercial aircraft, railcars, ships, and the like, as well as for installation in golf carts and other such small vehicles.

BACKGROUND OF THE INVENTION

Conventionally, beverage dispensing systems have required electrical or gasoline power. Therefore, these systems tend to be bulky and, therefore, are usually unsuitable for portable applications.

Typically, conventional beverage dispensing systems comprise a high pressure carbonator tank plumbed to a carbon dioxide ($CO_2$) cylinder through a pressure regulator in which the pressure to be supplied to the carbonator tank is reduced to approximately 90 pounds per square inch (psi). A motorized pump plumbed to a fixed water tap system is used to pressurize the water supplied to the tank to approximately 200 psi. The high pressure water flows into the carbonator tank, overcoming the rising pressure of the $CO_2$ gas contained therein. As the carbonator tank fills with this high pressure water, the a pocket of $CO_2$ gas is compressed, forcing the $CO_2$ gas to be absorbed into the water, thereby creating carbonated water. In that these conventional beverage dispensing systems require a constant source of power to operate the pump motor, use of such systems is generally limited to fixed installations.

Although portable beverage dispensing systems that do not require electrical or gasoline powered pumps have been developed, these systems have several disadvantages. One such system is that disclosed in U.S. Pat. No. 5,411,179 (Oyler et al.) and U.S. Pat. No. 5,553,749 (Oyler et al.). Similar to the systems described in the present disclosure, the system described in these patents uses high pressure $CO_2$ gas supplied by a $CO_2$ tank to pressurize the water that is supplied to a carbonator tank. Unlike the present systems described in the present disclosure, however, the system described in these patent references uses a low pressure carbonator. When a low pressure carbonator is used in beverage dispensing systems, the water entering the carbonator is at low pressure, typically under 100 psi.

Despite providing for some degree of water carbonation (typically approximately 2.5% carbonation), such low pressure systems do not produce beverages having a commercially acceptable level of carbonation (generally between 3.0% to 4.0% carbonation). Experimentation has shown that the pressurized water supplied to the carbonator tank must be cooled prior to a low temperature prior to entering the carbonator tank of these systems achieve absorption of $CO_2$ gas into the water. This cooling is typically effected by using a cold plate through which the pressurized water passes just prior to being supplied to the carbonator tank.

As mentioned above, low, albeit marginally acceptable, levels of carbonation can be attained through this method with these low pressure systems. One significant drawback of using this method, however, is that the $CO_2$ gas contained within the carbonated water can be quickly diffused from the water when it is heated to a warmer temperature. Accordingly, when the carbonated water is mixed with relatively warm liquids such as concentrated syrups, juices, and the like, the relatively small amount of carbonation can be quickly lost when post-mixing soft drinks in the conventional manner.

It therefore can be appreciated that it would be desirable to have a self-contained beverage dispensing system that is completely portable and that produces beverages having a commercially acceptable level of stable carbonation.

SUMMARY OF THE INVENTION

The present invention relates to a self-contained high pressure beverage dispensing system that is produces beverages having a commercially acceptable level of carbonation and is substantially portable.

Generally speaking, the present invention comprises a high pressure carbonator tank for facilitating absorption of $CO_2$ gas into water, a refillable source of $CO_2$ gas under high pressure, a source of water under high pressure, and a beverage dispenser valve. In addition to being supplied to the carbonator tank for carbonating water, the CO2 gas is used to pressurize the water source so that only high pressure water is provided to the carbonator tank.

In a first embodiment of the present invention, the high pressure water source comprises a high pressure water tank having a water chamber and a gas chamber that are separated by a pliable diaphragm. In operation, the water chamber is filled with water at a positive head pressure. Once the water chamber is adequately filled, high pressure CO2 gas is introduced into the gas chamber to urge the diaphragm against the water to increase its pressure.

In a second embodiment of the present invention, the high pressure water source comprises both a water tank and a high pressure water pump. Like the water tank of the first embodiment, the water pump of the second embodiment is pressurized with high pressure $CO_2$ gas. This gas urges an internal rodless piston toward the water side of the pump to increase the pressure of the water.

In either embodiment, the beverage dispensing system includes a carbonator tank water level switch that is coupled to a carbonator tank water valve. In a preferred arrangement, the water valve is pneumatically actuated and the water level switch is capable of sending a pneumatic pressure signal to the water valve to open it when low levels of water in the carbonator tank are sensed by the water level switch.

Thus, it is an object of this invention to provide a beverage dispensing system that is self-contained so as to be substantially portable.

Another object of this invention is to provide a beverage dispensing system that operates at high pressure such that a commercially acceptable level of water carbonation can be attained.

Other objects, features and advantages of this invention will become apparent upon reading the following specification, when taken in conjunction with the accompanying drawings.

DETAILED DESCRIPTION

Referring now in more detail to the drawings, in which like numerals indicate like parts throughout the several views, FIGS. 1–9 illustrate various embodiments of the self-contained, high pressure pneumatic beverage dispensing system of the present invention.

Figure 1:
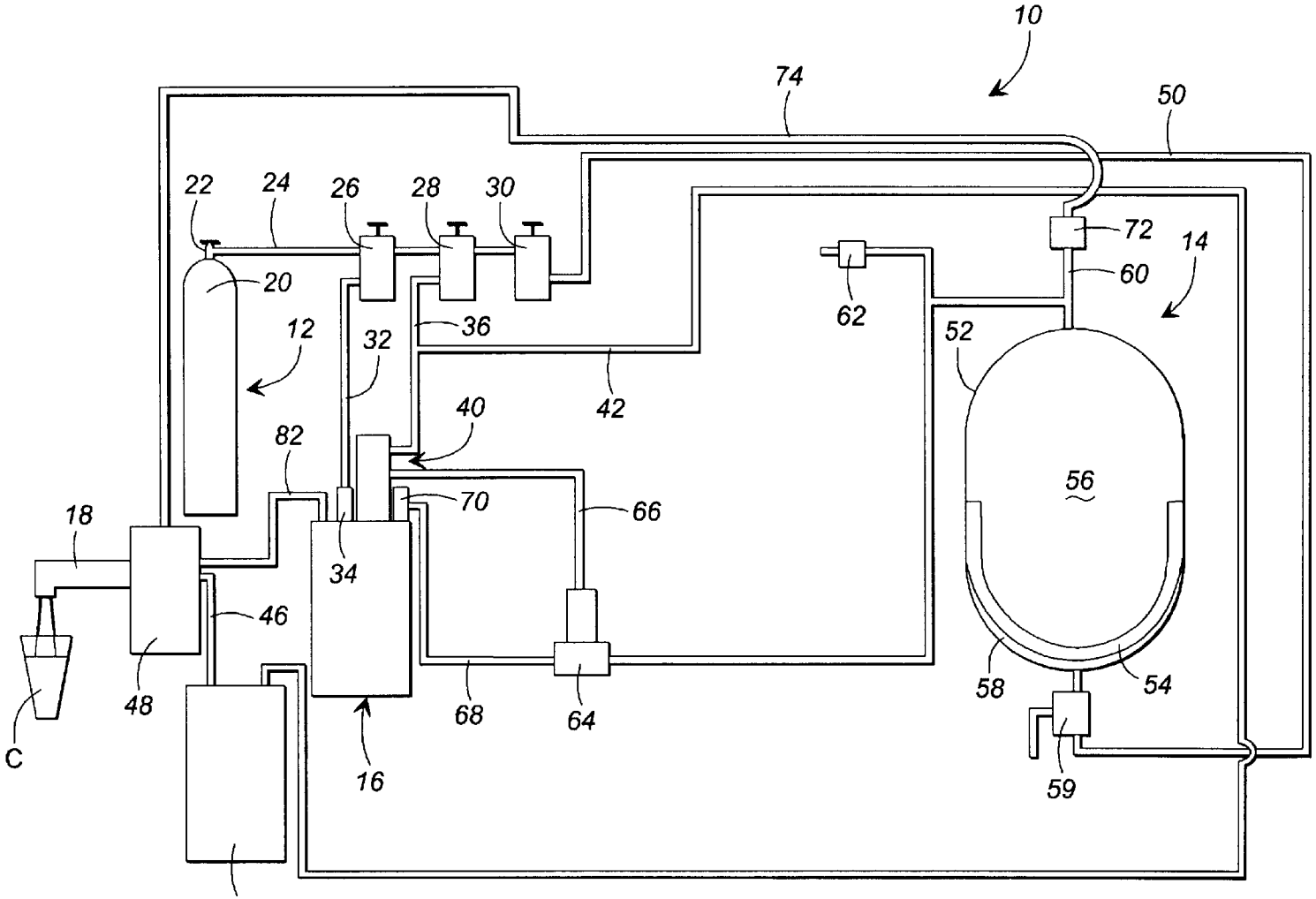
FIG. 1 is a schematic view of a first embodiment of the self-contained high pressure pneumatic beverage dispensing system of the present invention.

FIG. 1 is a schematic view of a first embodiment 10 of the self-contained high pressure pneumatic beverage dispensing system. The system generally comprises a source 12 of $CO_2$ at high pressure, a source 14 of high pressure water, a high pressure carbonator tank 16, and a beverage dispensing valve 18. The source 12 of $CO_2$ at high pressure typically comprises a conventional refillable gas storage tank 20 that is filled with pressurized $CO_2$ gas. As will be discussed in more detail below, the pressurized $CO_2$ gas contained within the gas storage tank 20 is used to both carbonate water in the carbonator tank 16 as well as pressurize and propel the water to be supplied to the carbonator tank.

The $CO_2$ gas exists the gas storage cylinder 20 through a gas shut-off valve 22. When the gas shut-off valve 22 is opened, $CO_2$ gas travels through a gas outlet pipeline 24 and is supplied to three separate gas pressure regulators 26, 28, and 30. The gas traveling through the first pressure regulator 26 is reduced in pressure to approximately between 90 psi to 110 psi and then exits the pressure regulator to enter a carbonator tank supply pipeline 32. The carbonator tank supply pipeline 32 directs the $CO_2$ gas to a gas inlet check valve 34 of the high pressure carbonator tank 16 so that the carbonator tank can be filled with pressurized $CO_2$ gas.

The $CO_2$ gas that travels through the second gas pressure regulator 28 in which the pressure of the gas is reduced to approximately between 25 psi to 60 psi. After exiting the second gas pressure regulator 28, the $CO_2$ gas flows into a carbonator tank water level switch pipeline 36. The water level switch pipeline is connected to a carbonator tank water level switch 40, the configuration and operation of which will be described in detail below.

Along the water level switch pipeline 36, between the second gas pressure regulator 28 and the water level switch 40, is a syrup container supply pipeline 42 that is in fluid communication with a concentrated syrup container 44. As is conventional in the beverage dispensing art, this syrup container stores concentrated syrup that can be mixed with carbonated water to make soft drinks such as sodas. When pressurized with gas pressure supplied through the syrup container supply pipeline 42, the concentrated syrup exits the syrup container 44 and flows through a syrup container outlet pipeline 46. The syrup container outlet pipeline 46 leads to a cold plate 48 in which the syrup is cooled to an appropriate serving temperature. From the cold plate 48, the syrup can then be discharged through the beverage dispenser valve 18 when desired. Although described as a concentrated syrup container which stores concentrated syrup, it will be understood by those having ordinary skill in the art that alternative concentrated liquids such as juice concentrate and the like could be substituted for the syrup if desired. Accordingly, the identification of a syrup container is not intended to limit the invention of the present disclosure.

The $CO_2$ gas supplied to the third gas pressure regulator 30 is lowered in pressure to approximately between 175 psi to 225 psi. After passing through the third gas pressure regulator 30, the $CO_2$ gas is ported through a high pressure gas supply pipeline 50 that supplies gas pressure to the pressurized water source 14 of the system. In this first embodiment, the water source 14 comprises a high pressure water tank 52. Although capable of alternative configurations, this water tank typically constructed of a strong metal such as stainless steel. Inside the water tank 52 is a flexible diaphragm 54 that separates the interior of the water tank into two separate chambers 56 and 58. The water or upper chamber 56 of the water tank is adapted to store water that will be supplied to the carbonator tank 16 for carbonization. The gas or lower chamber 58 is adapted to receive high pressure gas that is used to pressurize the water contained in the upper chamber. The flexible diaphragm 54 completely isolates each chamber from the other such that no mixture of the water and $CO_2$ gas can occur.

Connected to the water chamber side of the water tank 52 is a water chamber pipeline 60. Among other functions to be discussed below, the water chamber pipeline 60 is used to refill the water chamber 56 of the water tank 52. To refill the tank, a refill inlet check valve 62 connected to one branch of the water chamber pipeline 60 is connected to a source of water having positive head pressure which, depending upon personal preferences, can be standard or purified tap water. It will be understood that refilling should only be attempted when the water tank is in a depressurized state.

Positioned along the high pressure gas supply pipeline 50 between the third gas pressure regulator 30 and the water tank 52 is a three-way vent valve 59. The three-way vent valve is manually operable to control the pressurization or depressurization of the lower chamber 58 of the water tank. When switched to open position, the three-way vent valve 59 directs high pressure $CO_2$ gas into the lower chamber 58 of the water tank 52. This high pressure gas urges the pliable diaphragm 54 upward against the volume of water contained in the upper chamber 56 to increase the pressure of the water to a level within the range of approximately between 175 psi to 225 psi. When the operator wishes to refill the tank with water in the manner described above, the three-way vent valve 59 is then manually switched to a closed position in which the supply of high pressure $CO_2$ gas to the tank is shut-off, and the high pressure gas contained in the lower chamber of the water tank is vented to the atmosphere to relieve the pressure therein. This reduction of pressure within the tank 52 permits the operator to refill the tank with any water source capable of supplying water at a positive head pressure.

In addition to providing for refilling of the water tank 52, the water chamber pipeline 60 is further used to transport the pressurized water supplied by the water tank in two separate directions. In a first direction, the water is taken to a water valve 64 that is positioned intermediate the water tank 52 and the carbonator tank 16 along the water flow path existing between these two tanks. Typically, the water valve is pneumatically actuated to open or close to thereby permit or prevent the flow of water therethrough. In a preferred arrangement, the water valve 64 comprises a normally closed, gas actuated, high pressure bellows valve. Considered suitable for this use are HB Series bellows valves manufactured by Nupro. Coupled with a pneumatic signal pipeline 66, the water valve 64 and water level switch 40 are in fluid communication with one another. When supplied with a pneumatic pressure signal sent from the water level switch, the water valve 64 opens, permitting high pressure water supplied by the water tank 52 to pass through the valve and into a carbonator tank water supply pipeline 68. In use, the water is transported through this water supply pipeline to a water inlet check valve 70 that is mounted to the carbonator tank 16 such that the carbonator tank can be filled with the high pressure water.

In addition to transporting high pressure water in the first direction to the water valve 64, the water chamber pipeline transports the exiting the water tank 52 in a second direction to a water pressure regulator 72. This pressure regulator reduces the pressure of the water supplied from the water tank to approximately 40 psi. From the water pressure regulator 72, the water flows through a flat water supply line 74 and then through the cold plate 48 to be dispensed by the beverage dispenser 18 when activated by the operator.

Figure 2:
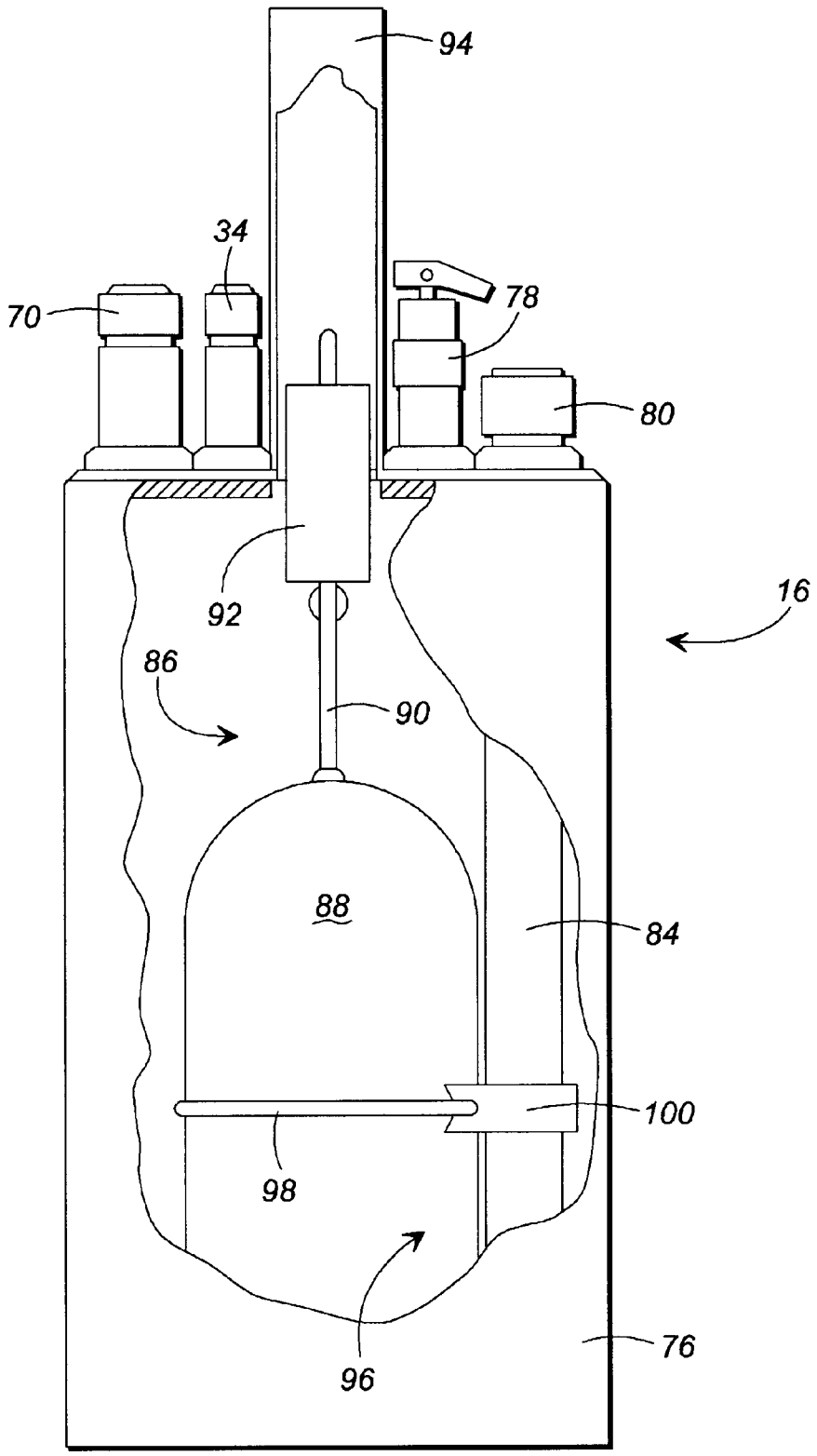
FIG. 2 is a cut-away side view of the high pressure carbonator tank used in the beverage dispensing system of FIG. 1.

Having generally described the primary components of the first embodiment of the invention, the configuration and operation of the high pressure carbonator tank will now be discussed. FIG. 2 illustrates, in cut-away view, the carbonator tank 16 preferred for use in the present embodiment. As depicted in the figure, the carbonator comprises a generally cylindrical tank 76. Mounted to the top of the tank 76 are the gas inlet check valve 34 and the water inlet check valve 70 as well as a safety relief valve 78 of conventional design. Further mounted to the top of the carbonator tank is a carbonated water outlet 80 that is fluidly connected to a carbonated water supply pipeline 82 (FIG. 1). Inside the tank is a carbonated water supply tube 84 that extends from the bottom of the tank up to the carbonated water outlet 80 such that, when the beverage dispenser valve 18 is activated, pressurized carbonated water from the bottom of the carbonator tank is forced through the supply tube 84, out of the carbonated water outlet 80, through the carbonated water supply pipeline 82, through the cold plate 48, and finally out of the dispenser valve into a suitable beverage container C.

In addition to the above components, the carbonator tank 16 further comprises a mechanical water level indicator system 86. This system includes a hollow float member 88 having a rod 90 extending upwardly from the top portion of the float member. Positioned on the top of the rod 90 is a magnetic cylinder 92. When the carbonator tank is empty, the float member 88 rests on the bottom of the carbonator tank. Situated in this empty configuration, part of the magnetic cylinder 92 is positioned within the tank and part is positioned within an elongated hollow tube 94 that extends upwardly from the top of the carbonator tank. This hollow tube permits travel of the rod and magnetic cylinder in the upward direction, the purpose for which will be provided herein. Presently considered to be in accordance with the above description is the Model M-6 carbonator available from Jo-Bell.

As described above, the float member 88 rests on the carbonator tank bottom when the tank is empty. However, as the carbonator tank is filled with water, the buoyancy of the float member causes it to float towards the top of the tank. To maintain the float member 88, rod 90, and magnetic cylinder 92 in correct orientation, a mechanical stabilizer 96 is provided. As illustrated in the figure, the stabilizer 96 comprises a retainer band 98 that is wrapped around the float member and a slide member 100 which is disposed about the carbonated water supply tube 84, and to which the retainer band is fixedly attached. Configured in this manner, the float member 88 will continue to rise within the carbonator tank 76 as the water level within the tank increases. Similarly, the magnetic cylinder 92 will rise within the elongated hollow tube 94 so that water level sensing means can detect when the tank is full so that water flow into the tank can be halted.

Figure 4:
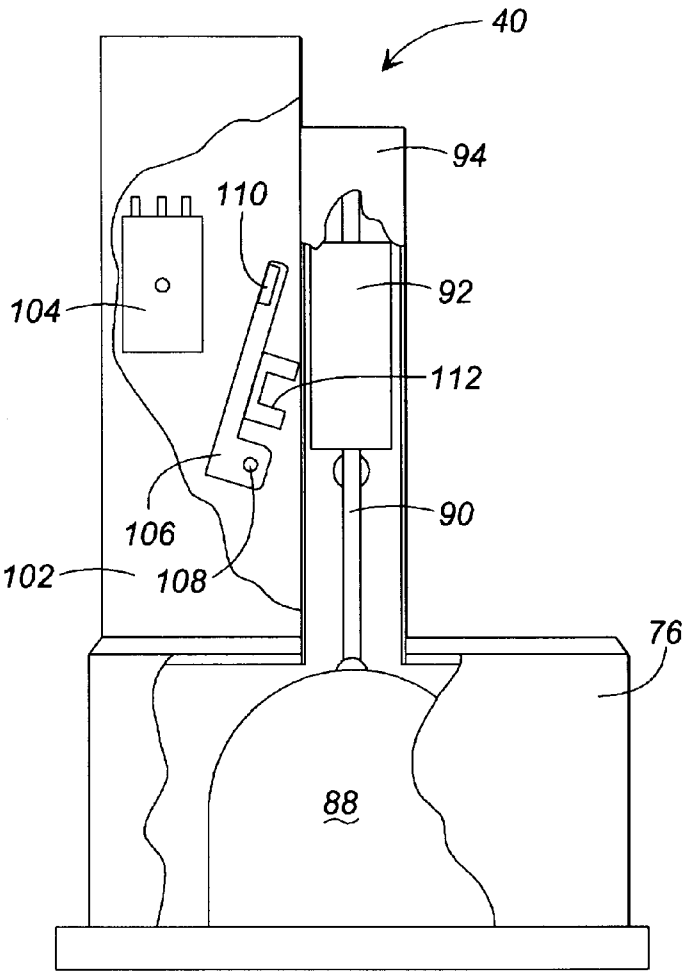
FIG. 4 is a partial side view of the carbonator tank of FIG. 2 with the pneumatic water level switch of FIG. 3 in cut-away view to depict the inactivated or full position of the pneumatic water level switch.
Figure 3:
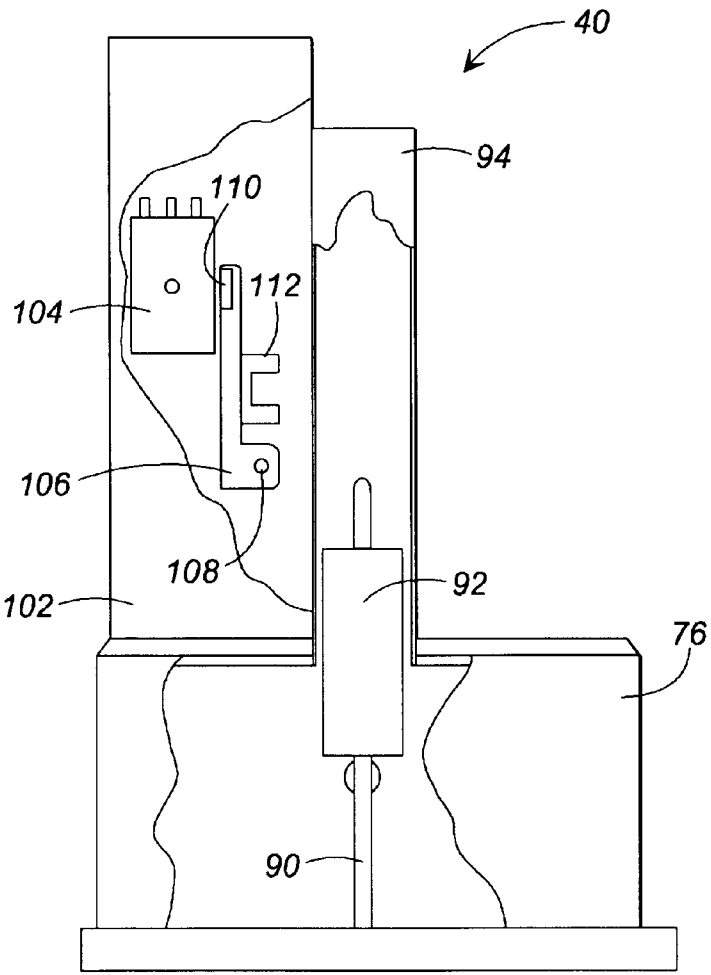
FIG. 3 is a cut-away side view of the carbonator tank of FIG. 2 with a pneumatic water level switch mounted thereto (and with all inlet and outlet valves removed), this switch also shown in cut-away view to depict the activated or fill position of the pneumatic water level switch.

As described above, the water level within the tank is monitored and controlled by a carbonator tank water level switch 40 that is mounted to the carbonator tank. FIGS. 3 and 4 illustrate the water level switch 40 and part of the carbonator tank in cut-away view. In a preferred aspect of the invention, the water level switch comprises an outer housing 102 that is adapted to abut the hollow cylinder 94 of the carbonator tank 16. Located within the housing 102 is a pneumatic three-way magnetic proximity switch 104 and a lever arm 106. While the proximity switch 104 is fixed in position within the housing, the lever arm 106 is free to rotate about a pin 108 such that the lever arm is pivotally mounted within the water level switch 40. Mounted to the lever arm 106 are first and second magnets 110 and 112. The first magnet is mounted to the arm at a position in which it is adjacent the proximity switch when the lever arm is oriented vertically as shown in FIG. 3.

Being attracted to the proximity switch 104, the first magnet 110 is maintains the lever arm in the vertical orientation when the tank is not fill. When in the lever arm is in this vertical orientation, positive contact is made with the proximity switch, thereby activating the switch and causing it to send a pneumatic pressure signal to the water valve 64 to remain open so that the carbonator tank can be filled. As the water level rises, however, the magnetic cylinder 92 within the hollow tube 94 rises, eventually moving to a position in which it is adjacent the second magnet 112 mounted on the lever arm. Since the magnetic cylinder 92 is constructed of a magnetic metal, such as magnetic stainless steel, the second magnet 112 of the lever arm is attracted to the cylinder. In that the attractive forces between the second magnet and the magnetic cylinder are greater than those between the first magnet and the proximity switch, the lever arm 106 pivots toward the magnetic cylinder as depicted in FIG. 4. By pivoting in this direction, contact between the first magnet and the proximity switch 104 is terminated, thereby deactivating the proximity switch. Being deactivated, the proximity switch then shuts-off the supply of pressurized $CO_2$ gas to the water valve 64, causing the normally closed valve to cut off the flow of water to the carbonator tank.

In operation, the above described beverage dispensing system can be used to dispense carbonated and noncarbonated mixed beverages, as well as any carbonated and noncarbonated unmixed beverages, in liquid form. To use the system, the water tank 52 is filled with water via the water tank refill check valve 62 and water chamber pipeline 60. Once the water tank has been filled to an appropriate level, the three-way vent valve 59 is manually switched to the gas open position such that the lower chamber 58 of the tank and the high pressure gas supply pipeline 50 are in open fluid communication with one another.

To initiate the carbonization process, the operator opens the shut-off valve 22 of the gas storage tank 20 so that high pressure $CO_2$ gas flows to the three gas pressure regulators 26, 28, and 30. After passing through the first pressure regulator 26, $CO_2$ gas flows into the carbonator tank 16, raising the pressure within the tank to approximately between 90 psi to 110 psi. At approximately the same time, the high pressure $CO_2$ gas also flows through the second and third pressure regulators 28 and 30. After exiting the second pressure regulator, the gas is supplied to both to the pneumatic three-way magnetic proximity switch 104 of the water level switch 40 and to the concentrated syrup container 44. The gas supplied to the proximity switch is used, as needed, to send pneumatic pressure signals to the water valve 64. After passing through the third pressure regulator 30, the high pressure gas passes through the high pressure gas supply line 50, through the three-way vent valve 59, and into the lower chamber of the water tank 52 to fill and pressurize the lower chamber, thereby pressurizing the water contained in the upper chamber of the tank.

As the $CO_2$ gas continues to flow into the lower chamber, the water is forced out of the tank and flows through the water chamber pipeline 60 to travel to both the carbonator tank water valve 64 and the water pressure regulator 72. The water that passes through the water pressure regulator is piped into and through the flat water supply pipeline 74 to be cooled by the cold plate 48 and, if desired, dispensed through the beverage dispenser valve 18.

Assuming the carbonator tank to initially not contain water, the float member 88 contained therein is positioned near the bottom of the tank and the water tank lever switch 40 is in the activated position shown in FIG. 3. Because the water tank lever switch is in this activated position, pneumatic pressure is provided to the water valve, keeping it in the open position so that water can flow into the carbonator tank. As the water continues to flow from the water tank 52 and fills all pipelines connected thereto, the pressure of the water begins to rise sharply. Eventually, the pressure of the water in the upper chamber and the pipelines in fluid communication therewith reach a pressure equal to that of the high pressure $CO_2$ gas contained in the lower pressure. Accordingly, water enters the tank at high temperature, typically between 175 psi to 225 psi.

Since the carbonator tank is relatively small when compared to the $CO_2$ container and water tank, it fills quickly. Therefore, carbonated water is available soon after the carbonization system is initiated. As such, the operator can use the beverage dispensing valve, commonly referred to as a "bar gun," to dispense either flat water supplied by the flat water supply line 74 or carbonated water supplied by the carbonated water supply pipeline 82. Similarly, concentrated syrup, or other concentrated liquid, can be dispensed such that a mixed flat or carbonated drink can be post mixed in a selected beverage container C.

Once the carbonator is full, the water level switch assumes the inactivated position, thereby shutting-off the supply of gas to the water valve 64. Not having the pressure signal needed to remain open, the water valve closes, cutting the supply of water to the carbonator tank. As the water level is again lowered, the water level switch is again activated, restarting the process described above. The system therefore cycles in response to the volume of water contained in the carbonator tank. The cycle occurs repeated during use of the system, until either the gas or water supplies are depleted. At this time, either or both may be refilled, and the system reinitiated.

Figure 5:
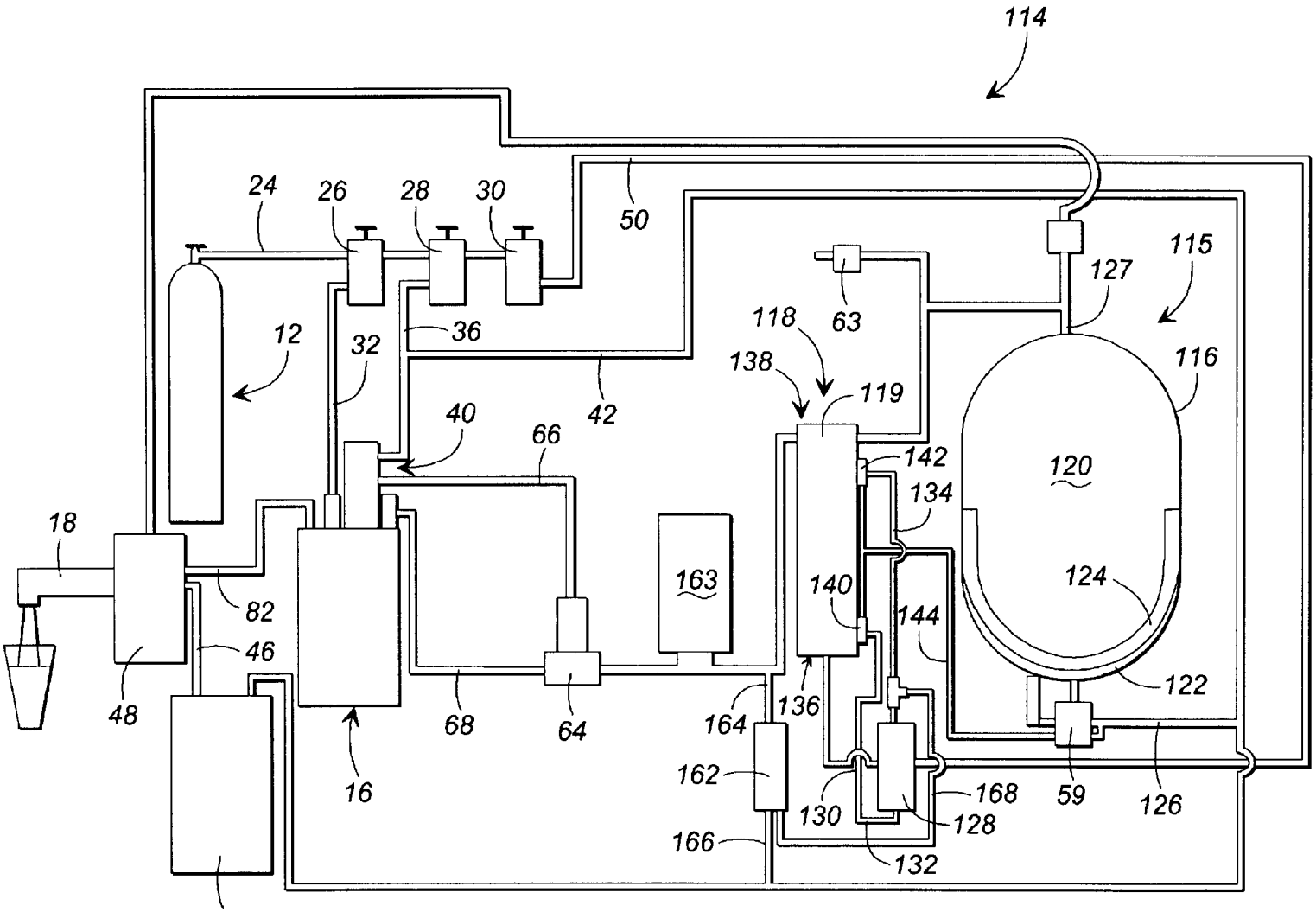
FIG. 5 is a schematic view of a second embodiment of the self-contained high pressure pneumatic beverage dispensing system of the present invention.

FIG. 5 is a schematic view of a second embodiment 114 of the self-contained high pressure pneumatic beverage dispensing system. Since the second embodiment is nearly identical in structure and function except as to the source of water and the pressure levels provided to the various component, the following discussion of the second embodiment of the system is focused on the water source 115 and these pressure levels.

In this second embodiment, the high pressure water tank of the first embodiment is replaced with a low pressure water tank 116 and high pressure water pump system 118 that includes a pneumatic water pump 119. The low pressure water tank is similar in construction to the high pressure water tank and therefore has upper and lower chambers 120 and 122 separated by a pliable diaphragm 124. Since a high pressure pump is included in the system, the water within the water tank need not be at high pressure. Accordingly, instead of being supplied with $CO_2$ gas at approximately between 175 psi to 225 psi, the water tank is supplied with gas at pressures approximately between 25 psi to 60 psi. Therefore, the water tank 116 is supplied with gas from a low pressure gas supply pipeline 126 that branches from the syrup container pipeline 42 described in the description of the first embodiment. Since it will not be subjected to high pressure $CO_2$ gas, the low pressure water tank can be constructed of mild steel as opposed to stainless steel which tends to be substantially more expensive. Similar to the water tank of the first embodiment, pressurized water can leave the upper chamber of the tank through a water chamber pipeline 127. In one direction, the pressurized water supplied by the water tank flows to the pneumatic water pump 119 to fill the pump with water.

As described above, the low pressure water tank 116 is supplied with gas from a low pressure gas supply pipeline that branches from the syrup container pipeline 42. Therefore, the high pressure gas supply pipeline 50 is not connected to the water tank. Instead, the high pressure gas supply pipeline supplies gas at approximately between 175 psi to 225 psi to a pneumatic water pump control valve 128. As shown in FIG. 5, in addition to the high pressure gas supply pipeline 50, the control valve 128 is connected to a pump gas supply pipeline 130, and first and second pneumatic signal lines 132 and 134. The pump gas supply pipeline 130 connects in fluid communication to the pneumatic water pump 119 at its first end 136. The pneumatic signal pipelines 132 and 134 connect to first and second piston sensors 140 and 142 respectively. The first piston sensor 140 is mounted to the pump adjacent its first end 136 and the second piston sensor 142 is mounted to the pump adjacent its second end 138. Each of the piston sensors 140 and 142 is connected to a sensor gas supply pipeline 144 which is in fluid communication with the low pressure gas supply pipeline 126.

Figure 6:
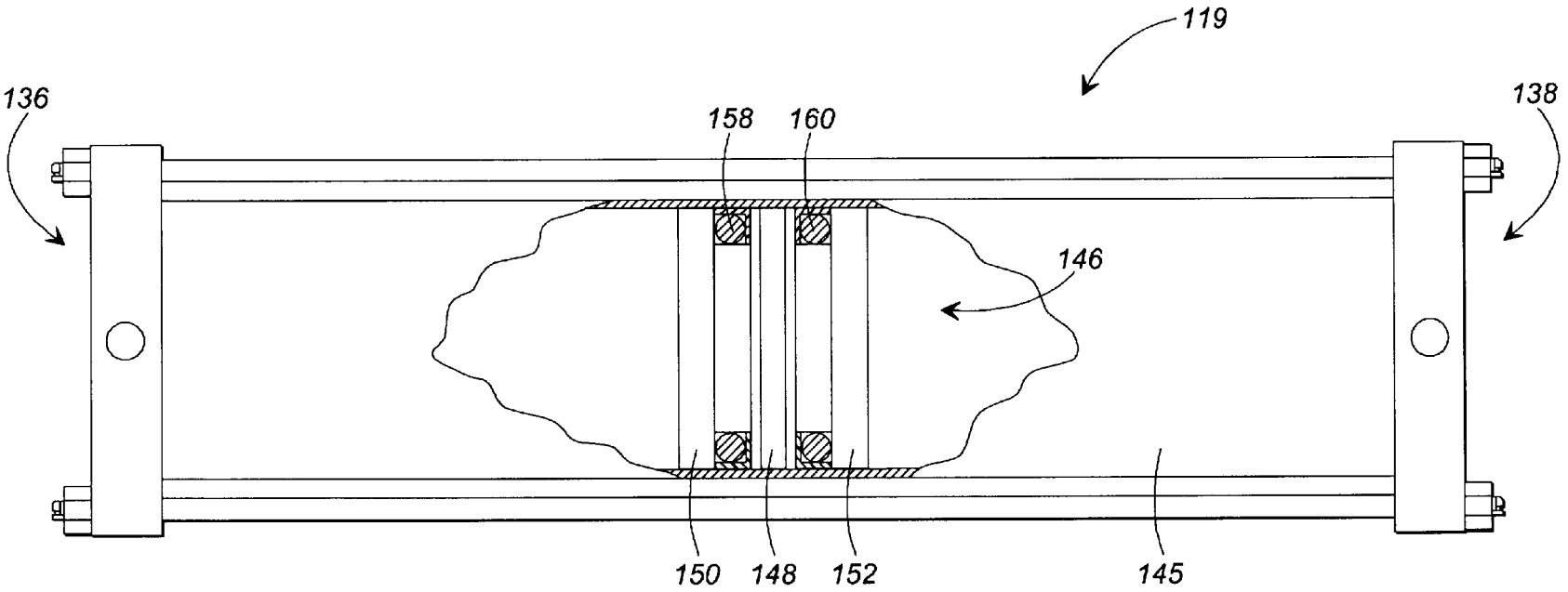
FIG. 6 is a partial cut-away view of the high pressure water pump used in the beverage dispensing system of FIG. 5 depicting the rodless piston contained within the cylindrical tube of the water pump.

As shown in FIG. 6, the pneumatic water pump 119 comprises a piston cylinder 145 and a rodless piston 146. The rodless piston comprises a central magnet 148 that is positioned intermediate two piston end walls 150 and 152. Located between the magnet 148 and each of the end walls 150 and 152 are seals 154 and 156. Typically, these seals comprise an inner resilient O-ring 158 and an outer lip seal 160. Configured in this manner, the seals 154 and 156 prevent fluids from passing between the piston 146 and the piston cylinder 145 but permit sliding of the piston along the cylinder.

In an initial filled state, with the piston positioned adjacent the first end of the pump, piston sensor 140 senses the proximity of the piston due to its magnetic attraction to the piston. When such a condition is sensed, the sensor is activated and sends a pneumatic pressure signal to the control valve, causing the control valve 128 to open. While in the open position, high pressure gas flows through the control valve, along the pump gas supply pipeline 130, and into the gas side of the pump. The high pressure gas ejects the water contained on the water side of the piston, eventually pressurizing the water to approximately between 175 psi to 225 psi.

From the pump 119, the pressurized water flows to the carbonator tank 16 similarly as in the first embodiment. When nearly all of the water is driven out of the pump with the piston, the second piston sensor 142 activates in similar manner to the first piston sensor, and sends a pneumatic pressure signal to the control valve 128 that causes the valve to cut-off the supply of gas to the pump and vent the pump cylinder so that the relatively low pressure can again fill the pump. Once the pump is completely filled, the first piston sensor is again activated, and the system cycles again.

Although the system, as described above, is believed to be complete and effective, the system can further include a pump reset switch 162 and/or an accumulator tank 163. As shown in FIG. 5, the reset switch 162 receives high pressure water from the pump through water supply pipeline 164. The reset switch also receives low pressure $CO_2$ gas from the syrup supply line 42 through gas supply pipeline 166. Linking the reset switch 162 and the pump control valve 128 is a pneumatic signal pipeline 168 which connects to pipeline 134. So described, the pump reset switch ensures that there is adequate amounts of carbonated water to meet the demand. For instance, if the piston pump is positioned at some intermediate point along the length of its stroke and the carbonator tank is filled, shutting the water valve 64 off, equilibrium can be achieved, dropping the pressure of the water, therefore indicating that the water pump 119 is not full. Upon sensing this water pressure drop, the reset switch 162 sends a pneumatic pressure signal to the control valve, causing the valve to close and vent the gas pressure in the pump so that the pump can be refilled.

Another optional component that ensures adequate supply of high pressure water is the accumulator tank 163. The accumulator tank contains an internal diaphragm (not shown) which separates the lower chamber of the tank from the upper chamber of the tank. In the upper chamber is a volume of nitrogen gas. In operation, the lower chamber fills with high pressure water supplied by the pump 119. As the accumulator is filled, the nitrogen gas contained in the upper chamber is compressed. In this compressed state, the gas can force the water out of the accumulator tank during situations in which carbonated water demand is high and the pump is in the refill portion of its cycle.

Figure 7:
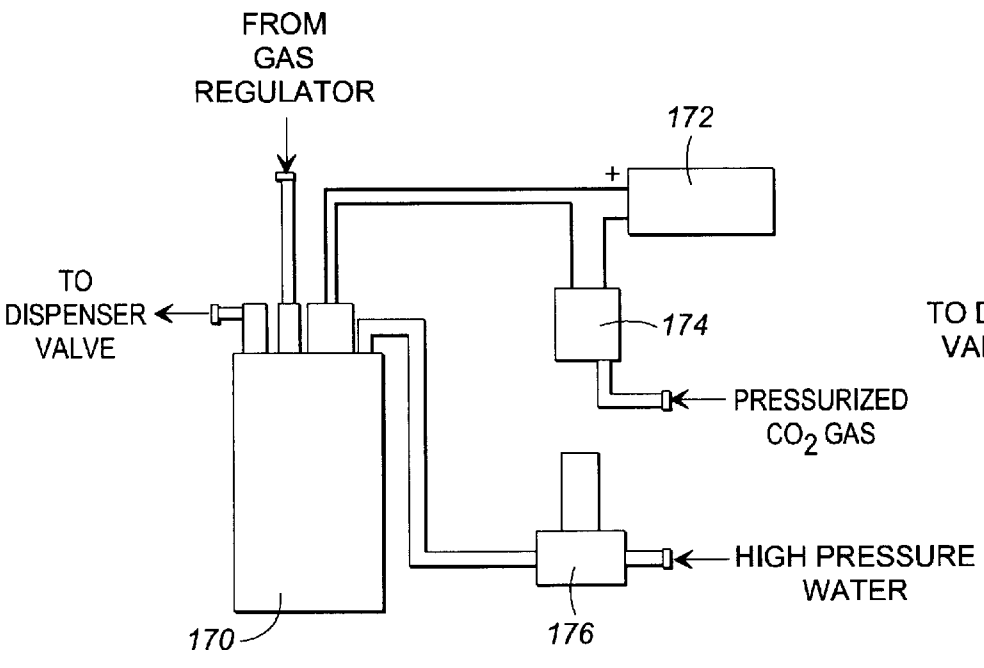
FIG. 7 is a schematic view of an alternative carbonator tank and filling system.

FIG. 7 illustrates an alternative carbonator tank and filling system comprising a conventional electrically sensed, high pressure carbonator tank 170 and an electric power source 172. Considered suitable for this application is any of the electrically sensed carbonator tanks produced by McCann. To ensure portability, the power source 172 typically comprises a battery. Electrically connected to the carbonator sensor (not shown) are both the power source and a low voltage pneumatic interface valve 174. The interface valve is in fluid communication with both a source of pressurized CO2 gas and a pneumatic water valve 176. When in operation, the electric sensors within the carbonator tank electrically signal the interface valve 174 when the carbonator tank is not full. This signal is received by the interface valve, causing it to open and thereby send a pneumatic pressure signal to the pneumatic water valve to cause it to open so that the carbonator tank can be refilled in the manner discussed above.

Figure 8:
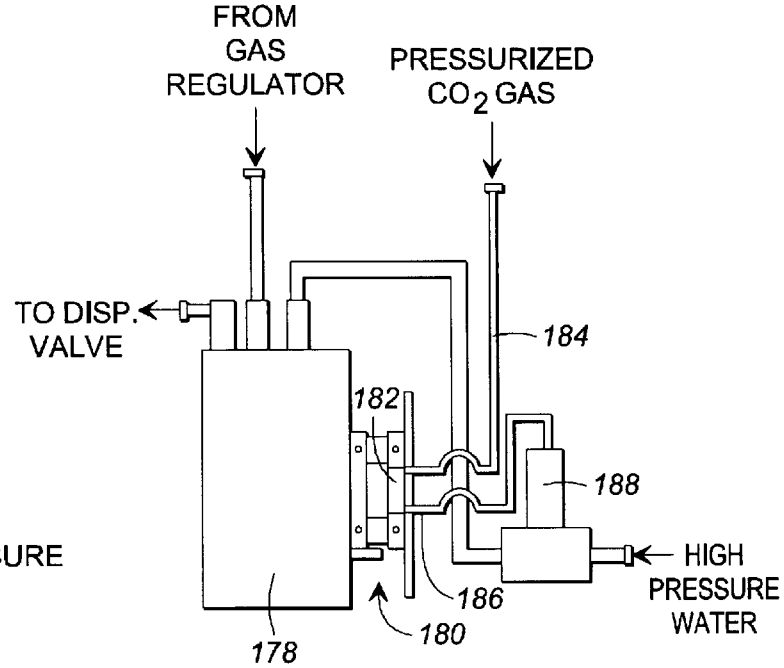
FIG. 8 is schematic view of another alternative carbonator tank and filling system.

FIG. 8 illustrates an further alternative carbonator tank and filling system which comprises a conventional high pressure carbonator tank 178. The carbonator tank is mounted to a vertical surface with a spring loaded carbonator mounting bracket 180. Coupled to this mounting bracket is a pneumatic three-way valve 182 that is in fluid communication with a high pressure $CO_2$ gas supply pipeline 184, a pneumatic signal pipeline 186 which is in turn connected to a pneumatic water valve 188.

When the tank is empty, it is supported by the carbonator mounting bracket 180 in an upright orientation. While in this upright orientation, the pneumatic three-way valve 182 is open, thereby sending a pneumatic pressure signal to the water valve to remain open. Once the tank is nearly full, however, its weight overcomes the strength of the spring within the bracket, causing the tank to tilt. This tilting action closes the three-way valve, which in turn closes the water valve 188 and shuts-off the supply of pressurized water to the carbonator.

While preferred embodiments of the invention have been disclosed in detail in the foregoing description and drawings, it will be understood by those skilled in the art that variations and modifications thereof can be made without departing from the spirit and scope of the invention as set forth in the claims. For instance, although the second embodiment of the invention is described as comprising a separate water tank and water pump, it will be understood by persons having ordinary skill in the art that these two components could essentially be combined into a single component such as a high volume, high pressure water pump. In such an arrangement, the pump would function similarly as the pump described in the second embodiment, however, would only complete one stroke instead of cycling between dispensing and refilling strokes. In addition, the pump control valve, piston sensors, and associated pipelines would be unnecessary since automated pump cycling would not be necessary.

We claim:

1. A self-contained high pressure pneumatic beverage dispensing system, comprising:

a carbonator tank for facilitating absorption of $CO_2$ gas in water to produce carbonated water;

a refillable source of $CO_2$ gas under high pressure, said refillable source of $CO_2$ gas being in fluid communication with said carbonator tank so as to fill said carbonator tank with $CO_2$ gas;

a source of water under high pressure, said source of water being in fluid communication with said carbonator tank so as to fill said carbonator tank with water;

a water valve in fluid communication with said source of water and said carbonator tank, said water valve having an open position in which water from said source of water can flow through said water valve and into said carbonator tank and having a closed position in which water from said source of water cannot flow through said water valve to said carbonator tank;

a water level switch operably connected to said carbonator tank and capable of sensing whether or not said carbonator tank is filled with water, said water level switch further being capable of sending a signal to said water valve that causes said water valve to open when a low water level inside said carbonator tank is sensed; and a beverage dispenser valve in fluid communication with said carbonator tank, wherein said beverage dispenser valve dispenses carbonated water when activated by the operator.

2. The self-contained high pressure pneumatic beverage dispensing system of claim 1, further comprising regulator means for regulating the pressure communicated to said carbonator tank from said source of $CO_2$ gas.

3. The self-contained high pressure pneumatic beverage dispensing system of claim 1, further comprising a cold plate through which the carbonated water flows after exiting said carbonator tank and before passing through said beverage dispenser valve.

4. The self-contained high pressure pneumatic beverage dispensing system of claim 1, further comprising a concentrated syrup container in fluid communication with said source of $CO_2$ gas and said beverage dispenser valve, said concentrated syrup container supplying concentrated syrup to said beverage dispenser valve so that the syrup can be mixed with the carbonated water to form soft drinks.

5. The self-contained high pressure pneumatic beverage dispensing system of claim 1, wherein said water valve is pneumatically actuated and said water level switch being in fluid communication with said source of $CO_2$ and capable of sending a pneumatic signal to open said water valve and supply water to said carbonator tank when a low water level inside said carbonator tank is sensed by said water level switch.

6. The self-contained high pressure pneumatic beverage dispensing system of claim 1, wherein said water level switch is capable of sending an electrical signal to open said water valve and supply water to said carbonator tank when a low water level inside said carbonator tank is sensed by said water level switch.

7. The self-contained high pressure pneumatic beverage dispensing system of claim 1, wherein said source of water comprises a high pressure water tank, said water tank having a water chamber and a gas chamber that are separated by a pliable diaphragm, said water chamber of said water tank adapted for containing water to be supplied to said carbonator tank and said gas chamber of said water tank being in fluid communication with said source of $CO_2$ gas that is to be used to pressurize said water tank, wherein when pressurized $CO_2$ gas is introduced into said gas chamber of said water tank, said diaphragm is forced against the water contained in said water chamber of said water tank to increase the pressure of the water contained therein.

8. The self-contained high pressure pneumatic beverage dispensing system of claim 1, wherein said source of water includes a water tank and a water pump in fluid communication with said water tank, said water valve, and said source of $CO_2$ gas, said water pump being adapted to receive high pressure $CO_2$ gas from said source of $CO_2$ gas, wherein the high pressure $CO_2$ gas is used to increase the pressure of the water supplied to said water pump by said water tank so that high pressure water will be available for filling said carbonator tank.

9. The self-contained high pressure pneumatic beverage dispensing system of claim 8, wherein said water pump comprises an piston cylinder having a gas inlet at a first end and a water inlet and water outlet at a second end, said water pump further comprising a rodless piston that is disposed within said piston cylinder between said first and second ends, wherein high pressure $CO_2$ gas supplied from said source of $CO_2$ can enter said piston cylinder through said gas inlet to collect on a first side of said rodless piston and water supplied from said water tank can enter said piston cylinder through said water inlet to collect on a second side of said rodless piston, such that the high pressure $CO_2$ gas urges said rodless piston toward said second end of said cylindrical tube to pressurize the water.

10. The self-contained high pressure pneumatic beverage dispensing system of claim 9, wherein said source of water further includes a pneumatic water pump control system that comprises a first piston sensor in fluid communication with said source of $CO_2$ and mounted to said piston cylinder adjacent its first end, a second piston sensor in fluid communication with said source of $CO_2$ and mounted to said piston cylinder adjacent its second end, and a pneumatic water pump control valve in fluid communication with said first and second piston sensors, said source of $CO_2$ gas, and said gas inlet of said piston cylinder, wherein said first piston sensor sends a pneumatic signal to said control valve when proximity of said piston is sensed to cause said control valve to open to permit high pressure $CO_2$ to enter said piston cylinder to pressurize the water contained therein and said second piston sensor sends a pneumatic signal to said control valve when proximity of said piston is sensed to cause said control valve to close and vent said $CO_2$ gas contained in said second side of said piston cylinder, thereby allowing pressurized water from said water tank to enter said water pump.

11. The self-contained high pressure pneumatic beverage dispensing system of claim 10, wherein said source of water further comprises a water pump reset system including a pneumatic pressure switch in fluid communication with said water outlet and said pneumatic water pump control valve, wherein when said pneumatic pressure switch senses low water pressure exiting said water pump, said pressure switch sends a pressure signal to said pneumatic water pump control valve to cause said piston to return to said first end of said piston cylinder to permit water to fill said piston cylinder.

12. A pneumatic water level switch adapted for use with a mechanical float carbonator tank having a central tube, said pneumatic water level switch comprising:

an outer housing adapted for mounting to the carbonator tank, said outer housing having an open face portion;

a magnetic proximity switch fixedly mounted within said outer housing; and a pivot arm pivotally mounted within said outer housing, said pivot arm having first and second ends, a first magnet fixedly mounted to said pivot arm adjacent said second end and a second magnet fixedly mounted to said pivot arm between said first and second ends, wherein said pivot arm is positioned within said housing such that said first magnet is adjacent said magnetic proximity switch, said second magnet is positioned adjacent said open face portion, and said pivot arm being pivotable toward and away from said magnetic proximity valve;

wherein when said housing is mounted to the carbonator tank with said open face portion adjacent the central tube, said pivot arm will pivot toward and activate said magnetic proximity switch when the carbonator tank is not full and will pivot away and deactivate said magnetic proximity switch when the carbonator tank is full.

13. The pneumatic carbonator tank filling control system of claim 12, wherein said carbonator tank level switch comprises a magnetic proximity switch and a pivot arm pivotally mounted adjacent said magnetic proximity switch, said pivot arm having first and second ends, a first magnet fixedly mounted to said pivot arm adjacent said second end and a second magnet fixedly mounted to said pivot arm between said first and second ends, wherein said pivot arm is positioned such that said first magnet is adjacent said magnetic proximity switch and said second magnet is positioned to be adjacent the carbonator tank central tube when said level switch is mounted to said carbonator tank, said pivot arm being pivotable toward and away from said magnetic proximity valve wherein said pivot arm will pivot toward and activate said magnetic proximity switch when the carbonator tank is not full and will pivot away and deactivate said magnetic proximity switch when the carbonator tank is full.

14. A pneumatic carbonator tank filling control system comprising:

a pneumatically actuated water valve having an open position in which liquid can flow through said water valve and a closed position in which liquid cannot flow through said water valve; and a carbonator tank level switch adapted to mount to a carbonator tank to be filled to a predetermined level with high pressure water, said carbonator tank level switch capable of sending a pneumatic signal to said pneumatically actuated water valve to open it when the water level within the carbonator tank falls below the predetermined level.

15. A self-contained high pressure pneumatic beverage dispensing system, comprising:

a carbonator tank for facilitating absorption of $CO_2$ gas in water to produce carbonated water;

a refillable source of $CO_2$ gas under high pressure, said refillable source of $CO_2$ gas being in fluid communication with said carbonator tank so as to fill said carbonator tank with $CO_2$ gas;

a source of water under high pressure, said source of water being in fluid communication with said carbonator tank so as to fill said carbonator tank with water;

a pneumatically actuated water valve in fluid communication with said source of water and said carbonator tank, said pneumatically actuated water valve having an open position in which water from said source of water can flow through said pneumatically actuated water valve and into said carbonator tank and having a closed position in which water from said source of water cannot flow through said pneumatically actuated water valve to said carbonator tank;

a water level switch in fluid communication with said source of $CO_2$ gas and said water valve, said water level switch operably connected to said carbonator tank and capable of sensing whether or not said carbonator tank is filled with water, said water level switch further being capable of sending a pneumatic signal to said pneumatically actuated water valve that causes said water valve to open when a low water level inside said carbonator tank is sensed; and a beverage dispenser valve in fluid communication with said carbonator tank, wherein said beverage dispenser valve dispenses carbonated water when activated by the operator.

* * * * *

UNITED STATES PATENT AND TRADEMARK OFFICE

CERTIFICATE OF CORRECTION

PATENT NO. : 6,021,922
DATED : February 8, 2000
INVENTOR(S) : Bilskie et al.

It is certified that error appears in the above-identified patent and that said Letters Patent is hereby corrected as shown below:

Title page,
Item [63], Related U.S. Application Data, should read
-- Provisional application No. 60/030,628, filed Nov. 8, 1996. --.

Signed and Sealed this

Twenty-third Day of May, 2006

JON W. DUDAS
*Director of the United States Patent and Trademark Office*